United States Patent [19]

Mentzel et al.

[11] Patent Number: 4,928,715

[45] Date of Patent: May 29, 1990

[54] CIGARETTE

[75] Inventors: Edgar Mentzel, Quickborn; Ferdinand Meixner, Gaggenau, both of Fed. Rep. of Germany

[73] Assignees: H. F. & Ph. F. Reemtsma GmbH & Co.; Schoeller & Hoesch GmbH, both of Fed. Rep. of Germany

[21] Appl. No.: 301,112

[22] Filed: Jan. 25, 1989

[51] Int. Cl.[5] ..... A74B 15/28
[52] U.S. Cl. ..... 131/365
[58] Field of Search ..... 131/365

[56] References Cited

U.S. PATENT DOCUMENTS

| | | | |
|---|---|---|---|
| 3,228,402 | 1/1966 | Lebert | 131/365 |
| 4,607,647 | 8/1986 | Dashley et al. | 131/365 |
| 4,624,268 | 11/1986 | Baker et al. | 131/365 |
| 4,739,775 | 4/1988 | Hampl | 131/365 |
| 4,825,885 | 5/1989 | Kounnas | 131/365 |

*Primary Examiner*—V. Millin
*Attorney, Agent, or Firm*—Eric P. Schellin

[57] ABSTRACT

The invention relates to a cigarette, which is characterized in that, by batonneing the patterned zones one or several times, the cigarette paper is adjusted from an initial air permeability to an average total air permeability of 85 to 20% of the initial value.

11 Claims, No Drawings

CIGARETTE

BACKGROUND OF THE INVENTION

1. Field of the Invention

The invention relates to cigarettes, whose tobacco core is enveloped by a cigarette paper wrapping having areas of higher and lower permeability to air in the form of patterned, i.e, preferably circular zones.

2. Prior Art

Such cigarettes are already known from DE-OS No. 25 59 071, in which the cigarette paper has lower porosity zones in a range of up to 100 and higher porosity zones in a range of 150 to 2000, with an average porosity of 50 to 500 units, said units being determined in $cm^3$/min per 10 $cm^2$ and at a pressure of 10 cm water column. In such known cigarettes the circular zones of alternating porosity are intended to bring about a controlled burning speed and/or an increased number of puffs.

In place of the porosity, DIN ISO/DIS No. 2965.2 gives the air permeability P as the air quantity in $cm^3$/minute, per $cm^2$ and per kilopascal. It is calculated from the ratio of volume air flow in $cm^3$/min, which is traversed by the test pattern, to the product of the test surface of the test pattern in $cm^2$ and the pressure difference between the two surfaces of the test pattern in kPa and used to be given as the so called "Coresta Value." The ISO/DIS No. 2965.2 was promulgated by the International Organization for Standardization and is incorporated herein by reference in its entirety. Thus, according to DE-OS No. 25 59 071 a cigarette paper is used, whose areas of lower porosity correspond to a permeability value of up to 10 P and preferably 5 P, whilst the areas of higher porosity have a value of 15 to 200 P, in the case of a total porosity of said cigarette paper of 5 to 50 P. On the basis of paper with high porosity, according to this reference the reduction of the porosity in the lower porosity areas can be brought about by applying gel-forming agents such as glue, methyl cellulose, gums or lacquers and varnishes. The cigarette papers indicated as being of low porosity therein and having a porosity of approximately 3.6 P can be perforated electrostatically or by pressure rollers or marking presses, so as to obtain higher porosity zones, the average porosity being approximately 24 P. The smouldering rates of such known cigarettes are e.g. in a range of 3.2 mm/min for a number of puffs of 9.7, whereas cigarettes with a conventional paper and an average porosity of approximately 26 P have a smouldering rate increased e.g. to 4.2 mm/min and a number of draws reduced e.g. to 7.5.

It is also known from DE-OS No. 23 15 613 to reduce the porosity of the paper by abrading its thickness, in order to increase the paper permeability or porosity. This allegedly makes it possible to favourably influence the flavour of the cigarette and the structure of the cigarette paper is not weakened by perforations.

It is also known from German Patent No. 17 61 500 to provide compressed regions in the form of a lattice or waffle-like pattern, e.g. a silicate slurry and to reinforce the intersection points with a non-combustible material, so as in particular to prevent the dropping of ash.

It is also known from U.S. Pat. No. 3,911,932 to use cigarette papers, whose porosity increases towards the tip, so that the smoke supply is more uniform.

To the extent that these known proposals are technically realizable, although they lead to certain advantages, the latter are obtained at the cost of other desired characteristics, because the essential parameters, such as the smouldering speeds of the tobacco and paper, air permeability of the cigarette paper, ventilation of the tobacco core and filter, tobacco quantity and moisture, as well as filling density and the geometrical construction of the cigarette influence in a very complex manner the smoking behaviour, the formation of side stream smoke and the number of puffs.

For example, in order to reduce the side stream smoke, the smouldering speed of the cigarette core must be reduced, because at lower smouldering speeds less tobacco is burned in the interval between puffs (according to DIN No. 10240=58 sec) and consequently less side stream smoke is produced. During puffing (according to DIN No. 10240=2 sec) roughly a standard tobacco quantity is burned, because the influence of the air to be drawn through the glow burning area dominates (according to DIN No. 10240=35 ml/2 sec).

In the case of normal smoulderable tobacco mixtures, the reduction of the smouldering rate of the cigarette core can be brought about by using low porosity paper, or normal porosity paper with smouldering rate-reducing additives. However, in the case of non-smoulderable, e.g. moister tobacco mixtures, a low smouldering rate can only be obtained through using highly smoulderable cigarette papers. However, the undesired side-effect of all these measures is a high number of puffs, because less tobacco is burned in the interval between puffs.

SUMMARY OF THE INVENTION

The problem of the present invention is, independently of the smoulderability of given tobacco mixtures, to propose cigarettes which, for different core ventilation levels, but conventional numbers of puffs, produce less side stream smoke, or to provide cigarettes which as a result of their low porosity cigarette paper, have a low smouldering rate, but a conventional number of puffs, or which in the case of normal porosity cigarette paper and without additional additives reducing the smouldering rate with normal smoulderable tobacco give a conventional number of puffs, or cigarettes which, in the case of high porosity cigarette paper, without such additives and with low smoulderable tobacco, also give a conventional number of puffs and in each case a side stream smoke=reduced cigarette.

It has been found that on the basis of conventional cigarette papers with an air permeability of approximately 10 to 250 P. whose air permeability has been significantly reduced by imitation watermarking or batonneing has been reduced one to several times, compared with conventional cigarette papers having the same basic paper characteristics and the same air permeability, over proportional smouldering time increases are achieved or an unexpectedly large smouldering rate reduction is obtained.

This overproportional smouldering time rise for still comparatively high air permeabilities compared with conventional and side stream smoke-reducing cigarette papers, makes it possible to produce cigarettes with reduced side stream smoke and conventional numbers of puffs.

It has been found that the overproportional smouldering time of the inventive batonned cigarette paper is associated with a corresponding increase in the smouldering time of the cigarette produced with it, but there is no rise in the number of puffs per cigarette. The latter would have been expected, because generally a smouldering time rise of paper and cigarette leads to a corresponding rise in the number of puffs. Surprisingly the number of puffs is kept constant with cigarettes according to the invention. This means a considerable reduction in the side stream smoke in the case of a noticeably reduced smouldering rate of the cigarette, corresponding to the number of batonneing steps of the cigarette paper because, with a low cigarette smouldering speed, the burning rate in the non-puffing interval is low but, as a result of the constant number of puffs is high during actual puffing. This additionally leads to a better utilization for the consumers of the tobacco quantity used.

An advantage of the cigarette according to the present invention is that a control of the cigarette characteristics is achieved without any additions to the tobacco or the paper wrapping therefor. In addition, the cigarette paper with compression zones can be incorporated into the manufacturing process of the wrapping of the cigarette, so that this measure for controlling the cigarette characteristics can be performed extremely cost effectively.

The batonneing of cigarette paper is known per se and is e.g. mentioned in "Tobacco Encyclopedia" by E. Voges (1984) and takes place by embossing the paper on filigree calender. The paper is guided between or through the pressure nip of an embossing roll or an embossing roller and a more resilient or elastic hard paper roller, the dry or semi-dry paper being compressed at the embossed points. As a result of this embossing company or trademarks marks are embossed in and at these points the paper is denser and the embossed mark appears dark on a light background on the cigarette in plan view and light on a white background when viewed through the paper. The impression of an imitation watermark is obtained. The intensity of batonneing can be influenced by adjusting the absolute paper wetness in a range of approximately 1 to 10%, through the applied pressure of approximately 5 to 3000 Newton/cm and at different temperatures from room temperature to 95° C.

When batonneing cigarette paper, it is e.g. possible to use an embossing calender, which comprises an upper pressure roller, a back pressure roller below it and an embossing roller below it, a lower back pressure roller below it and a rigid lower pressure roller. The pressure rollers are usually steel rollers with a diameter of 32.0 cm and a working width of 119 cm. The back pressure rollers engaging with the embossing roller are paper-covered rollers with a diameter of 27.0 cm and a working width of 119 cm. The embossing roller is an engraved steel roller with a diameter of e.g. 19.4 cm and a working width of 118 cm, on whose circumference are provided circularly arranged, raised webs or grids which, as a function of the desired batonneing, e.g. have an individual width of 0.05 cm and a spacing of 0.05 cm. However, they can also lead to a different embossing between the webs or grids, if the webs or grids are made wider or higher. Generally the cigarette paper is drawn from a conventional unwiding device in a working width of 100 cm into the pressure gap between the embossing roller and the lower back pressure roller. By means of side regulation and paper guide rollers, the path is continuously controlled and, after batonneing, the paper is optionally wound with an interposed width stretching device. Winding generally takes place at a speed of 100 to 200 m/min, the drive of the roller combination being synchronized. Particularly good results are obtained at operating temperatures between 30° and 50° C. and a paper wetness of 5% to 7% absolute.

Batonneing of the cigarette papers can also take place during cigarette manufacture and is then carried out outside or directly in the cigarette making machine. The embossing calender can have a much smaller working width corresponding to the finished, cut-to-size cigarette paper, consequently being smaller and requiring lower operating pressures. In this case, the zone batonneing additional device is e.g. located between cigarette paper reels and the format finger of a conventional cigarette making machine, so that clock periods and controls of the cigarette paper to undergo batonneing can be more simply realized. The punch or cutting mechanism of the cigarette making machine can also be directly or synchronously coupled to the batonneing additional device.

DETAILED DESCRIPTIONS OF THE INVENTION

EXAMPLE 1

Test cigarettes with conventional tobacco mixtures were produced.

Conventional cigarette paper was set to a low total air permeability in zones at right angles to the running direction with a width of approximately 0.4 mm and a spacing of 1 mm by batonneing one or several times in the starting air permeabilities given in the following table.

As a function of the number of batonneing (bat.) steps, column A and B reveal a clear drop in the air permeability the surprising overproportional decrease of the "paper" smouldering(s) rate and a corresponding decrease in the "cigarette" smouldering(s) rate, as well as the surprising relatively constant number of puffs.

| | | P values | Paper sec./150 mm | Cigarette sec/50 mm | n/50 mm |
|---|---|---|---|---|---|
| | 11/07 | 11.1 | 65.0 | 616 | 6.8 |
| A | 1 × bat. | 9.35 | 68.8 | 663 | 7.1 |
| | 2 × bat. | 8.07 | 76.6 | 707 | 7.6 |
| | 3 × bat. | 8.07 | 79.1 | 752 | 7.6 |
| | 4 × bat | 7.86 | 86.4 | 760 | 77 |
| | 83/07 | 90.1 | 56.8 | 523 | 7.7 |
| B | 1 × bat. | 83.7 | 58.6 | 505 | 7.5 |
| | 2 × bat. | 80.3 | 65.8 | 524 | 7.3 |
| | 3 × bat. | 69.1 | 64.8 | 562 | 7.2 |
| | 4 × bat. | 59.5 | 68.6 | 542 | 7.6 |
| | 5 × bat. | 54.4 | 63.7 | 547 | 7.6 |
| | 6 × bat. | 52.5 | 74.3 | 584 | 7.2 |
| | 7 × bat. | 49.7 | 72.5 | 560 | 7.5 |
| | 8 × bat. | 45.9 | 76.0 | 575 | 7.2 |
| | 9 × bat. | 33.4 | 73.5 | 625 | 7.1 |
| | 10 × bat. | 28.0 | 73.5 | 618 | 7.2 |

Example 2

In test cigarette in accordance with Example 1 and using a cigarette paper with a relatively high initial air permeability of 235 P, but with other basic paper characteristics and other impression widths obtained by batonneing than those in Example 1, namely for a width of 1 mm, a spacing of approximately 2 mm and a low smoulderable tobacco mixture, the number of puffs was approximately 7.9 for a paper imitation watermarked 4 to 5 times. The values are given in Table 2.

| Paper Type | Air permeability in P values | Smouldering Rate Paper sec./150 mm | Smouldering Rate Cigarette sec./50 mm | Number of puffs N/50 mm |
|---|---|---|---|---|
| 20/07 | 235 | 64.6 | 596 | 7.6 |
| 1 × bat. | 180 | 65.5 | 612 | 7.4 |
| 2 × bat. | 139 | 68.6 | 628 | 7.6 |
| 3 × bat. | 128 | 68.8 | 635 | 7.5 |
| 4 × bat. | 101 | 70.2 | 644 | 7.9 |
| 5 × bat. | 77.9 | 73.4 | 657 | 7.8 |

As a function of the number of batonneing steps, Table 2 shows the clear drop in the air permeability, the marked decrease in the "paper" and "cigarette" smouldering rates, as well as the surprisingly constant average number of puffs.

What is claimed is:

1. A cigarette having less side stream smoke and a decreased smouldering rate for a constant average number of puffs, said cigarette having a tobacco core that is enveloped by a cigarette paper wrapping, which has areas with higher and lower air permeability in the form of patterned zones, comprising a cigarette paper adjusted from an initial air permeability of 10 to 250 P, determined as the air quantity in cubic centimeters per minute per square centimeter and per kilopascal to an average total air permeability of 85 to 20% of the initial value, by batonneing patterned zones on said paper.

2. The cigarette according to claim 1, wherein the cigarette paper is adjusted from an initial air permeability of 80 to 130 P to an average total air permeability of 30 to 80 P.

3. The cigarette according to claim 2, wherein the zones compressed by batonneing are circular.

4. The cigarette according to claim 3, wherein the zones compressed batonneing are approximately 0.1 to 8 mm wide and have a spacing of 0.1 to 5 mm.

5. The cigarette according to claim 4, wherein the compressed circular zones have a width of approximately 0.3 to 0.5 mm and a spacing of 1 mm.

6. The cigarette according to claim 4, wherein both the impression widths and the spacings of said batonned circular zones on a cigarette are of different sizes.

7. The cigarette according to claim 6, wherein the impression widths decrease in the case of equal distances from the filter.

8. The cigarette according to claim 6, the same impression widths, the spacings increase towards the filter.

9. The cigarette according to claim 8, wherein the impression zones are optionally in the form of interrupted lines, waves, diamond shaped or are in zig-zag form.

10. The cigarette according to claim 9 the impression zones pass in the longitudinal direction of the cigarette.

11. The cigarette according to claim 1 wherein the cigarette paper is batonned on both sides.

* * * * *